US009180954B2

(12) United States Patent
Glückhardt et al.

(10) Patent No.: US 9,180,954 B2
(45) Date of Patent: Nov. 10, 2015

(54) POWER SUPPLY DEVICE

(75) Inventors: Reimund Glückhardt, Wietmarschen (DE); Hans-Erhard Schmidt, Melbeck (DE)

(73) Assignees: Siemens Aktiengesellschaft, Munich (DE); Stemman-Technik GmbH, Schuettorf (DE)

( * ) Notice: Subject to any disclaimer, the term of this patent is extended or adjusted under 35 U.S.C. 154(b) by 181 days.

(21) Appl. No.: 14/002,825

(22) PCT Filed: Feb. 23, 2012

(86) PCT No.: PCT/EP2012/053044

§ 371 (c)(1),
(2), (4) Date: Sep. 11, 2013

(87) PCT Pub. No.: WO2012/116919

PCT Pub. Date: Sep. 7, 2012

(65) Prior Publication Data

US 2013/0341144 A1 Dec. 26, 2013

(30) Foreign Application Priority Data

Mar. 2, 2011 (DE) ..... 10 2011 004 992

(51) Int. Cl.
*B63J 3/04* (2006.01)
*E02B 3/20* (2006.01)

(52) U.S. Cl.
CPC ... *B63J 3/04* (2013.01); *E02B 3/20* (2013.01); *B63J 2003/043* (2013.01)

(58) Field of Classification Search
CPC ..... B63J 3/04; B63J 2003/043; B63J 99/00; E02B 3/20
USPC ..... 191/12 R, 12 C
See application file for complete search history.

(56) References Cited

U.S. PATENT DOCUMENTS

| | | | | |
|---|---|---|---|---|
| 5,788,033 | A * | 8/1998 | Lucking et al. | 191/33 R |
| 7,845,155 | B2 * | 12/2010 | Jaeker | 59/78.1 |
| 7,967,120 | B2 * | 6/2011 | Popesco | 191/12.2 R |
| 8,026,629 | B2 | 9/2011 | Schmidt et al. | |
| 8,061,493 | B2 * | 11/2011 | Kemper et al. | 191/12 R |
| 8,061,495 | B2 * | 11/2011 | Ichimura | 191/33 R |
| 8,499,911 | B2 * | 8/2013 | Ichimura | 191/12 R |
| 2007/0251784 | A1 * | 11/2007 | Popesco | 191/12.2 A |
| 2008/0256921 | A1 * | 10/2008 | Jaeker | 59/78.1 |
| 2009/0127048 | A1 * | 5/2009 | Ichimura | 191/33 R |
| 2010/0320049 | A1 * | 12/2010 | Kemper et al. | 191/12 R |
| 2012/0031721 | A1 | 2/2012 | Glueckhardt et al. | |

(Continued)

FOREIGN PATENT DOCUMENTS

| | | |
|---|---|---|
| DE | 235752 | 5/1986 |
| DE | 102009015603 A1 | 10/2010 |

(Continued)

*Primary Examiner* — Zachary Kuhfuss
(74) *Attorney, Agent, or Firm* — Laurence A. Greenberg; Werner H. Stemer; Ralph E. Locher

(57) ABSTRACT

A power supply device for a ship stationed on a mooring of a harbor includes a land-based, horizontally displaceable carriage, on which a power supply line with a plug is disposed for supplying the ship with electrical energy. The power supply line can be electrically connected to a land-based power supply network. A plug-side section of the power supply line is disposed in a vertically displaceable manner on the carriage.

8 Claims, 2 Drawing Sheets

(56) References Cited

U.S. PATENT DOCUMENTS

| | | | | |
|---|---|---|---|---|
| 2012/0043291 | A1* | 2/2012 | Ichimura | 212/312 |
| 2012/0111681 | A1 | 5/2012 | Feger | |
| 2013/0292222 | A1* | 11/2013 | Feger | 191/12 R |

FOREIGN PATENT DOCUMENTS

| | | | | |
|---|---|---|---|---|
| FR | 2647604 | A1 | 11/1990 | |
| GB | 1121715 | A | 7/1968 | |
| JP | 5558719 | A | 5/1980 | |
| WO | 2006079636 | A1 | 8/2006 | |
| WO | WO 2010023527 | A3 * | 6/2010 | |
| WO | WO 2010101244 | A1 * | 9/2010 | B66C 13/12 |
| WO | 2010139870 | A1 | 12/2010 | |

* cited by examiner

POWER SUPPLY DEVICE

BACKGROUND OF THE INVENTION

Field of the Invention

The electrical energy required on board ships in harbor is generally generated by diesel motor generator units on board. During the operation of such diesel motor generator units not insignificant quantities of diesel waste gases are produced, which contain among other things carbon dioxide and nitrous gases and are harmful to the environment.

Consideration is currently being given to supplying a ship in harbor with electrical energy from the land by means of a flexible power supply line, known as a cable line. Such electrical energy (electric power) is supplied by means of an electrical power supply network disposed in the harbor and transferred to the ship by means of the power supply line. It is possible here to transfer a section of the power supply line provided with a plug from land to ship to connect the power supply line to a socket disposed on board the ship.

BRIEF SUMMARY OF THE INVENTION

The object of the invention is to specify an apparatus, with which the electrical energy supplied on land can be transferred in a simple and safe manner to the ship.

According to the invention this object is achieved by a power supply device as follows:

This power supply device for a ship stationed at a harbor mooring, in particular a cruise ship, comprises a land-based carriage that can be displaced horizontally (in particular along the mooring), on which a power supply line with a plug is disposed to supply the ship with electrical energy. The power supply line here can be or is connected electrically to a land-based power supply network. A plug-side section of the power supply line is disposed in a vertically displaceable manner on the carriage. The power supply device is a cable supply system, with which the plug-side section of the power supply line can be displaced/moved vertically and horizontally.

It is particularly advantageous here that the power supply line or the section of the power supply line provided with the plug is disposed in such a manner that it can be moved along the mooring and therefore along the ship stationed at the mooring. The plug-side section (e.g. the plug-side end) of the power supply line can thus be moved to the point of the mooring where it is required for the ship stationed there in each instance. This is particularly advantageous as a very wide range of different ships can be stationed at a harbor mooring, for example ships of very different sizes and structure. With each of these ships the power supply line provided with the plug may be required at a different point of the ship, as the associated socket on the ship may be disposed at a different point on the ship in each instance. The horizontal movement of the power supply line to the socket on the ship advantageously avoids the power supply line having to lie loose and unprotected over long distances on the mooring quay. A power supply line lying unprotected over long distances of the harbor area in this manner would represent a considerable source of danger, as vehicles driving in the harbor could drive over the power supply line, thereby damaging it, or because passengers could trip over the power supply line. The fact that the carriage can be moved horizontally along the mooring means that the power supply line can be transported to the ship over the shortest possible distance, specifically for example at a right angle from the carriage to the land-side outer wall of the ship.

The power supply device is advantageously also embodied so that the plug-side section of the power supply line is disposed in a vertically displaceable manner. This means that the plug-side section of the power supply line can also be displaced vertically, in additional to the horizontal movement or alignment, for example to the level at which the plug is required on the outer wall of the ship. (There may be a hatch for the passage of the power supply line at this point on the outer wall). This allows the power supply line to be fed to the ship in a suspended and protected manner above the heads of harbor workers or above vehicles driving round the mooring. This avoids the risk of accident. The vertically displaceable arrangement of the plug-side section of the power supply line also advantageously allows compensation for vertical movement of the ship due to the tides.

The power supply device can be embodied in such a manner that the plug-side section of the power supply line is disposed in such a manner that it can also be displaced in a perpendicular direction to the plane spanned by the movement direction of the carriage and the vertical. This allows the plug-side section of the power supply line advantageously to be displaced toward the ship stationed at the mooring or back from the ship in the direction of the quay. It is thus possible in a simple and safe manner to transfer the plug of the power supply line to the ship when establishing the power supply line and move it over to the land when removing the power supply line.

The power supply device can also be embodied in such a manner that the carriage is disposed on rails, which run along the mooring. These rails allow precise horizontal movement of the carriage along the mooring, in other words along the ship stationed at the mooring.

The power supply device can also be embodied in such a manner that a first crossbar linkage is disposed on the carriage and can be moved out in a vertical direction to displace the plug-side section of the power supply line vertically. Such a crossbar linkage allows the plug-side section of the power supply line to be moved out over corresponding (extensive) vertical paths, which can be matched to the requirements of the respective ship type and the respective quay (for example over a vertical travel path of 4 meters). This first crossbar linkage also advantageously allows compensation for any vertical movement of the ship due to the tides.

The power supply device can also be embodied in such a manner that a second crossbar linkage is disposed on the carriage and can be moved out perpendicular to the plane spanned by the movement direction of the carriage and the vertical. This second crossbar linkage advantageously allows the plug-side section of the power supply line to be displaced over extensive paths perpendicular to said plane, in other words toward the ship and from the ship.

The power supply device can also be embodied in such a manner that the power supply device has a circuitless socket, into which the plug can be plugged when not in use. This circuitless socket (so-called blind socket), into which the plug can be plugged when not in use, advantageously protects the contacts of the plug from dirt when the power supply device is not in use and holds the plug in a defined position, thereby avoiding damage to the plug. This blind socket is provided with an electric heater (shutdown heater), by means of which the plug is protected from condensation and/or other external environmental influences when at rest.

The power supply device can also be embodied in such a manner that it comprises a parking chamber so that the carriage can be parked in a protected manner when not in use.

The carriage can be moved into said parking chamber when not in use, so that the carriage can be parked in particular in such a manner that it is protected from environmental influences.

The power supply device can also be embodied in such a manner that the parking chamber is let into the surface of the mooring quay. The arrangement of the parking chamber let into the surface of the quay advantageously allows the carriage to be parked without impeding the loading and unloading traffic on the quay, in particular without impeding cranes.

The power supply device can also be embodied in such a manner that the power supply line is passed within a chain (so-called cable chain), which comprises movably connected chain links and which limits the minimum bending radius of the power supply line during carriage movement. The passage of the power supply line in such a chain provides mechanical protection for the power supply line and also limits the minimum bending radius of the power supply line, so that the power supply line cannot be kinked in an impermissibly sharp manner during carriage movement, thereby preventing damage to the power supply line.

The power supply device can also be embodied in such a manner that the chain is let into the surface of the mooring quay. The arrangement of the chain let into the surface of the mooring quay represents a particularly advantageous arrangement of the chain, as the ship loading and unloading operations taking place on the quay are not impeded by the chain and the power supply line running therein. The let-in cable chain here is covered with a steel plate cover (so-called Panzerbelt cover), which can withstand a 40 t load. This means that even telescopic cranes or similar vehicles required for example for repair purposes can drive over or stand on the cable chain.

BRIEF DESCRIPTION OF THE SEVERAL VIEWS OF THE DRAWING

The invention is described in more detail below based on an exemplary embodiment, to which end.

DESCRIPTION OF THE INVENTION

Figure 1:
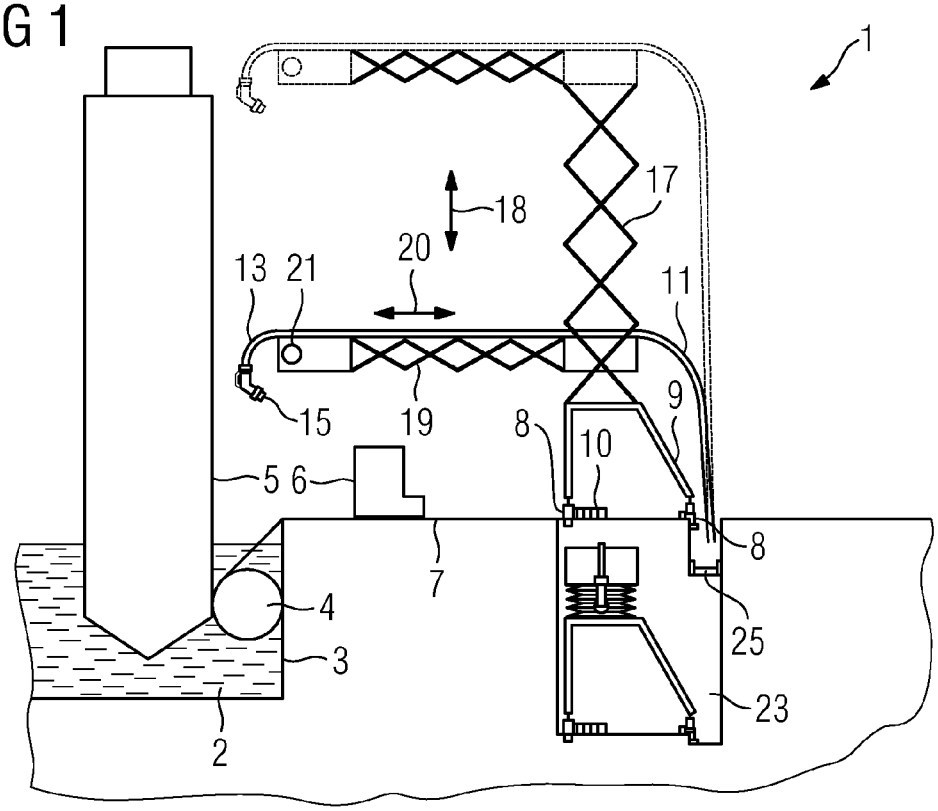
FIG. 1 shows a partially lateral section of an exemplary embodiment of the power supply device

FIG. 1 shows a schematic view of an exemplary embodiment of a power supply device 1 for a ship stationed at a harbor mooring, in this instance a cruise ship.

The mooring has a quay wall 3, which delimits a water-filled harbor basin 2. A fender 4 is present on the quay wall to protect a ship 5 mooring at the mooring. The ship 5 is moored to bollards 6 disposed on the quay wall 3; the fender 4 ensures a protective distance between ship 5 and quay wall 3.

The quay wall 3 forms part of the land-based quay 7. Rails 8 are fitted on the quay 7, extending parallel to the quay wall 3 (perpendicular to the image plane in the diagram in FIG. 1). These rails 8 therefore run along the mooring 3. A horizontally movable carriage 9 is shown on the rails 8, which can be moved horizontally along the mooring (perpendicular to the image plane). The horizontal movement of the carriage is made possible by means of two motors 10. Disposed on the carriage 9 is a flexible power supply line 11, with an electric plug 15 at its one end 13.

Disposed on the carriage 9 is a first crossbar linkage 17, by means of which the power supply line 11 and the plug 15 can be displaced vertically. The vertical displacement is indicated by means of an arrow 18. Such a crossbar linkage 17 is also referred to as a Ruthmann loader and can be embodied in the manner of an aerial platform or a snake fence. When the first crossbar linkage 17 is retracted (i.e. folded up), the power supply line 11 with the plug 15 is in a position as shown in the center part of FIG. 1 with continuous lines. The power supply line 11 with the plug 15 is then in a lower position. When the first crossbar linkage 17 is extended (i.e. folded out), the power supply line 11 with the plug 15 is in an upper position. This is shown in the upper part of FIG. 1 with broken lines. By extending and retracting the first crossbar linkage 17 it is possible to displace the power supply line 11 with the plug 15 over a considerable vertical distance, in the exemplary embodiment over approx. 4 m. This allows the position of the plug to be matched to the requirements of the respective quay and/or ships.

A second crossbar linkage 19 is also disposed on the carriage 9 and can be extended and displaced in a perpendicular direction to a plane spanned by the movement direction of the carriage 9 and the vertical. This extension or displacement is indicated by an arrow 20. FIG. 1 shows the second crossbar linkage 19 in the extended (i.e. folded out) state, in which the plug-side end 13 of the power supply line 11 is displaced in the direction of the harbor basin. In this state the plug 15 can be transferred to the ship 5 stationed at the mooring and it can be connected to a suitable socket or socket system on board the ship.

When the second crossbar linkage 19 is in the retracted (folded in) state (not shown in FIG. 1), the plug-side end 13 of the power supply line 11 is above the carriage 9, roughly between the bollards 6 and the carriage 9. The second crossbar linkage 19 therefore allows the plug-side end 13 of the power supply line 11 to be extended or retracted perpendicular to the plane spanned by the movement direction of the carriage 9 and the vertical, thereby allowing said end 13 to be moved in a perpendicular direction onto a ship stationed at the mooring or in a perpendicular direction away from said ship.

The power supply device 1 also has a circuitless socket 21 (i.e. a socket that is not connected, a so-called blind socket), into which the plug 15 can be plugged when not in use. This protects the contacts of the plug 15 from dirt and the end 13 of the power supply line 11 with the plug 15 is in a defined position when the power supply device 1 is not in use.

The power supply device 1 has a parking chamber 23 so that the carriage 9 can be parked in a protected manner when the carriage 9 is not in use. In the exemplary embodiment this parking chamber 23 is let into the surface of the quay 7 of the mooring, preferably at one end of the rails 8. To retract the carriage 9 into the parking chamber 23, parts of the rails 8 are lowered together with the carriage 9, until the carriage is in the underground parking chamber 23. The parked carriage is shown with broken lines in the lower part of FIG. 1.

The parking chamber 23 can also be disposed above ground and be embodied in the manner of a garage for example.

The power supply line 11 (only shown schematically in the figures) is passed within a chain (so-called cable chain), which has movably connected chain links and limits the minimum bending radius of the power supply line 11 during horizontal carriage movement. The chain 25 is let into the surface of the quay 7 of the mooring in the exemplary embodiment, as shown on the right edge of FIG. 1.

Figure 2:
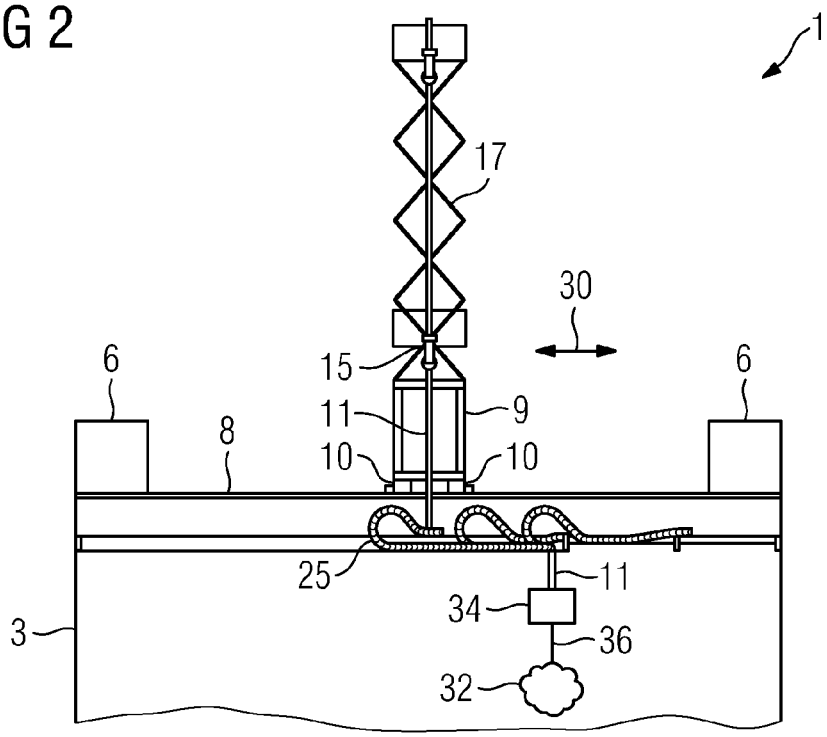
FIG. 2 shows the power supply device viewed from the front and FIG. 3 shows an exemplary embodiment of a power supply line passed within a cable chain.

FIG. 2 shows the power supply device 1 as viewed from the ship 5 or the harbor basin, with some parts shown transparent for greater clarity. Parts of the quay 7 in particular are shown transparent to reveal the chain 25, which is let into the surface of the quay 7. The power supply line 11 is passed within the cable chain 25. FIG. 2 shows the cable chain 25 in three different positions, corresponding to three different horizontal movement positions of the carriage 9 along the mooring. The horizontal movement of the carriage 9 is indicated by means of an arrow 30.

The power supply line 11 can be or is connected electrically to a land-based power supply network 32, in particular a medium voltage network. The electrical energy supplied by the medium voltage network 32 can therefore be transferred by way of the power supply line 11 and the plug 15 to the ship stationed at the harbor mooring. The power supply line 11 here can preferably be connected by way of a cable connection box 34 (or alternatively by way of a transition sleeve (not shown)) to a medium voltage cable 36 of the medium voltage power supply network 32. The medium voltage cable can be laid here in the harbor area in an empty tube system or in a cable shaft in the ground. Control lines and/or communication lines (e.g. fiber optic cables) can be passed from the power supply network to the plug 15 together with the power supply line 11 (cable line), to establish a communication link between harbor-side facilities and the ship.

Figure 3:
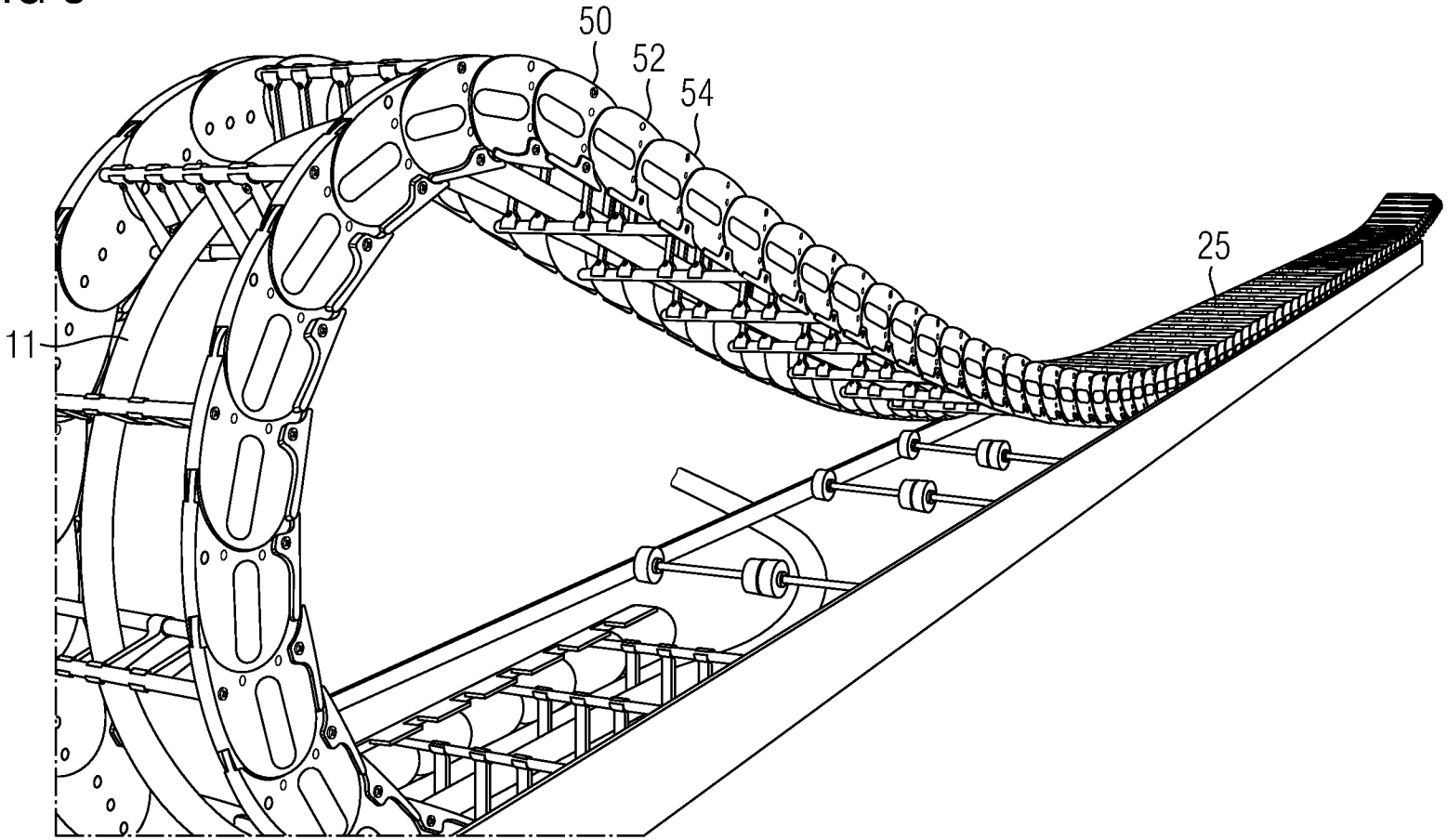

FIG. 2 shows a cable chain, in the form of the cable chain 25. This cable chain 25 has movably connected chain links 50, 52, 54, etc., which allow bending of the cable chain and the power supply line 11 passed therein and thereby limit the minimum bending radius of the power supply line 11. In the left part of FIG. 3 the power supply line 11 has the minimum bending radius, which corresponds to the illustrated minimum bending radius of the cable chain 25. The cable chain 25 allows the power supply line 11 to pass along the quay 7 in a protected manner, allowing movement of the carriage 9 along the mooring.

A power supply device 1 for a ship stationed at a mooring of a harbor has been described. This power supply device has the structure of a flexible and movable installation on the quay wall or quay. The power supply line 11 here is passed safely on an aboveground or underground support system 25, 9, the power supply line being kept away from the danger area of the quay and thereby being protected from damage due to transport, loading and unloading traffic on the quay. The end of the power supply line 11 provided with the plug 15 can be moved or displaced in all three dimensions with the power supply device. As a result it is possible to approach for example any outer hatch in the land-side outer wall of the ship to be used for the land-based power supply precisely with the plug-side end of the power supply line. The power supply device can be operated manually, fully automatically or remotely, as required. The power supply line is fed safely to the ship from the land side and introduced through the outer hatch in the ship's wall into the ship. The plug is then plugged into the socket on the ship with strain eliminated and mechanically and/or electrically locked. The ship can then be supplied with electric power supplied on the land side from the power supply network.

The invention claimed is:

1. A power supply device for a ship, including a cruise ship, stationed at a mooring of a harbor, the power supply device comprising:

a land-based carriage configured to be displaced horizontally;

a power supply line disposed on said carriage and configured to be electrically connected to a land-based power supply network to supply the ship with electrical energy;

a parking chamber configured to park said carriage in a protected manner when said carriage is not in use, said parking chamber being sunken into a base of a quay of the mooring;

said power supply line having a plug-side section vertically displaceably disposed on said carriage; and said power supply line having a plug at said plug-side section.

2. The power supply device according to claim 1, wherein:

said carriage has a movement direction;

said movement direction and the vertical span a plane; and said plug-side section is configured to be displaced perpendicular to said plane.

3. The power supply device according to claim 1, which further comprises rails running along the mooring, said carriage being disposed on said rails.

4. The power supply device according to claim 1, which further comprises a first crossbar linkage disposed on said carriage and configured to be extended in a vertical direction to displace said plug-side section of said power supply line vertically.

5. The power supply device according to claim 1, wherein:

said carriage has a movement direction;

said movement direction and the vertical span a plane; and a second crossbar linkage is disposed on said carriage and is configured to be extended perpendicular to said plane.

6. The power supply device according to claim 1, which further comprises a circuitless socket configured to receive said plug when said plug is not in use.

7. The power supply device according to claim 1, which further comprises a chain within which said power supply line is passed, said chain having movably connected chain links and said chain limiting a minimum bending radius of said power supply line during movement of said carriage.

8. The power supply device according to claim 7, wherein said chain is sunken into the base of the quay of the mooring.

* * * * *